US011779090B2

(12) United States Patent
Chousou et al.

(10) Patent No.: US 11,779,090 B2
(45) Date of Patent: Oct. 10, 2023

(54) MULTI-PURPOSE FOLDING BAG SYSTEM WITH HANDLE

(71) Applicants: Sofia Chousou, Athens (GR); Georgios Stamopoulos, Athens (GR)

(72) Inventors: Sofia Chousou, Athens (GR); Georgios Stamopoulos, Athens (GR)

( * ) Notice: Subject to any disclaimer, the term of this patent is extended or adjusted under 35 U.S.C. 154(b) by 267 days.

(21) Appl. No.: 17/044,797

(22) PCT Filed: May 22, 2019

(86) PCT No.: PCT/IB2019/000399
§ 371 (c)(1),
(2) Date: Oct. 1, 2020

(87) PCT Pub. No.: WO2019/193421
PCT Pub. Date: Oct. 10, 2019

(65) Prior Publication Data

US 2021/0112938 A1 Apr. 22, 2021

(30) Foreign Application Priority Data

Apr. 2, 2018 (GR) ..... 20180100139

(51) Int. Cl.

| | |
|---|---|
| ***A45C 3/04*** | (2006.01) |
| ***A45C 7/00*** | (2006.01) |
| ***A45C 3/00*** | (2006.01) |
| ***B65D 30/06*** | (2006.01) |
| ***B65D 33/06*** | (2006.01) |

(52) U.S. Cl.
CPC ..... *A45C 7/0077* (2013.01); *A45C 3/001* (2013.01); *A45C 3/045* (2013.01); *B65D 29/04* (2013.01); *B65D 33/06* (2013.01); *A45C 2003/002* (2013.01)

(58) Field of Classification Search
CPC ..... A45C 7/0077; A45C 13/26; A45C 13/28; A45C 7/00; A45C 3/045; A45C 3/001045; A45C 2003/002; B65D 29/04; B65D 33/06
USPC ..... 383/4, 14
See application file for complete search history.

(56) References Cited

FOREIGN PATENT DOCUMENTS

| | | | | |
|---|---|---|---|---|
| BR | MU9 001 587 U2 | | 1/2012 | |
| CH | 205383 A | * | 6/1939 | |
| CH | 216 845 A | | 9/1941 | |
| CH | 242966 A | * | 6/1946 | |
| GB | 2411825 A | * | 9/2005 | ..... A45C 13/26 |
| GB | 2 457 512 A | | 8/2009 | |

* cited by examiner

*Primary Examiner* — Jes F Pascua
*Assistant Examiner* — Nina K Attel
(74) *Attorney, Agent, or Firm* — Intelletek Law Group, PLLC; Gabriel Daniel, Esq.

(57) ABSTRACT

A multi-purpose folding bag system with a handle, having the form of a decorating element-keyring, consisting of the main body of cylindrical shape, at the one end of which there is a detachable head, which when detached, allows the net bag located in the storage place of the main body to unfold, and when it is then fitted to the other end of the main body, an anatomical handle is created for the easy and safe transport of the items placed into the net bag. Following its use, the net bag is repositioned within the storage place, whereas the detachable head is attached to the free end of the main body which again acquires the form of a decorative element-keyring.

6 Claims, 3 Drawing Sheets

MULTI-PURPOSE FOLDING BAG SYSTEM WITH HANDLE

CROSS-REFERENCE TO RELATED APPLICATIONS

This is a U.S. national stage of application No. PCT/162019/000399, filed on 22 May 2019, which claims priority to the Greek Application No. GR 20180100139 filed Apr. 2, 2018, the content of both incorporated herein by reference.

BACKGROUND

Technical Field

The present disclosure relates to a multi-purpose folding bag system with a handle comprising a main body having the form of a decorative element-keyring of cylindrical shape, where the head of the one end of said main body, when it is detached and attached to its other end, creates the handle of the bag, which is stored inside the cylindrical main body.

Related Art

The hitherto known bag/carrier bag manufacture technology has no such similar item to present. More specifically, during the last years, the use of the plastic bag is increasingly polluting the environment and is opposed to the ecological consciousness that we need to acquire. The above, in conjunction with the plastic bag use fee, made it imperative to replace the plastic bags with other type of bags which shall not be disposable and shall not pollute the environment.

In order to solve the above problem, multi-purpose bags/carrier bags, made either of fabric or durable plastic or net have circulated in the market, which, however, have the following disadvantages:

With regard to fabric bags, they have the disadvantage that, after some uses, they require washing, and the use of water and detergent reduce their beneficial properties in terms of their ecological character.

In addition, due to their manufacture material, these particular bags usually occupy much space, so it is not easy to carry them on a daily basis if the purchase of some goods is not planned.

The proposed folding storage bags usually have an increased cost and it is also difficult to reposition the bags in their storage place.

All of the above disadvantages have prompted us to find a solution, the result of which is the subject of the present description.

With our invention the above disadvantages have been eliminated because the invented system:

a. It is small in size and is very easy to carry, as it can be hung on the keys, the bag or anywhere else the user wishes.

b. It is very easy to use, as with a simple move it turns into a durable bag with a firm handle.

c. Because of the anatomical shape of the handle, that it is created even when the bag is full of heavy objects, said handle is not tiring for the palm.

d. It is easy to clean the system as the handle is easily cleaned while the folding bag with a simple rinse remains clean without requiring a great deal of water and detergent consumption.

e. It is easy to reposition the bag inside the structure.

f. It is easy and inexpensive to replace the bag in case of damage due to the intelligent structure of the system.

g. It is easy to create more sizes to meet more needs.

SUMMARY

According to one embodiment, a multi-purpose folding bag system with a handle is provided. The bag comprises a main body having inside a storage place and the one end of which there is a removable head, which when detached from the end of the main body, it allows the net bag located in the storage place to unfold. Whereas, when it is then fitted to the other end of the main body an anatomical handle is created for the easy and safe transport of the goods to be placed into the net bag attached to the two ends of the main body.

In one embodiment, the main body has, at both ends, safety fasteners on which the net bag is safely attached.

In one embodiment, the detachable head of the main body, which at its end has a socket in order for the system to be hung on keys, the bag, or anywhere else the user wishes.

In one embodiment, the main body is cylindrical.

In one embodiment, the main body is made of plastic or polymeric material.

In one embodiment, the main body is metallic.

In one embodiment, wherein, when the user wishes, the net bag is folded and repositioned within the storage place which secures by moving and attaching the detachable head from the end to the free end of the structure.

In one embodiment, wherein, in order for the net bag to be replaced, it is disconnected from the safety fasteners on which it is attached and respectively the new net bag is attached.

These and other features will become apparent from the following detailed description of illustrative embodiments thereof, which is to be read in connection with the accompanying drawings.

BRIEF DESCRIPTION OF THE DRAWINGS

In order to make our invention understood by those skilled in the art, reference is made to the accompanying drawings, which illustrate a specific industrial embodiment thereof.

In particular.

Figure 1:
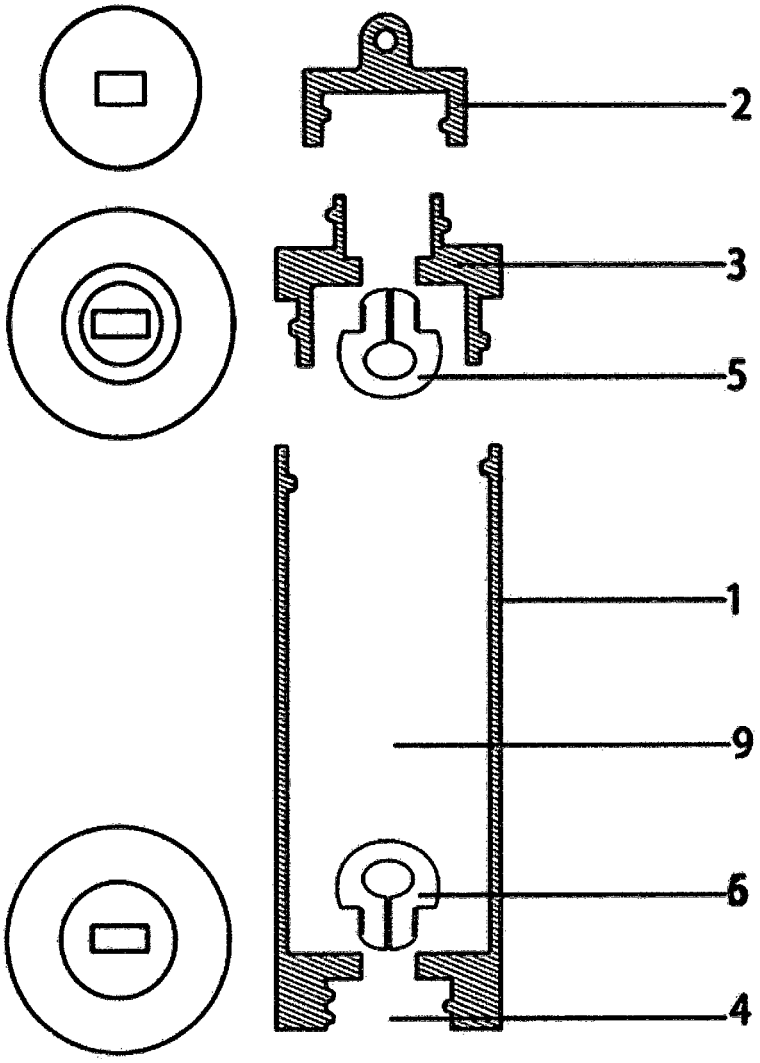
FIG. 1 depicts a section of the invented system in a folded state.
Figure 2:
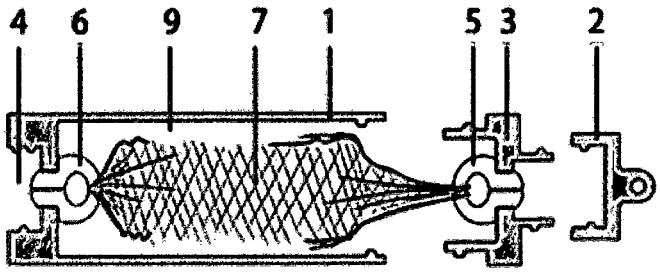
FIG. 2 depicts the invented system folded.
Figure 3:
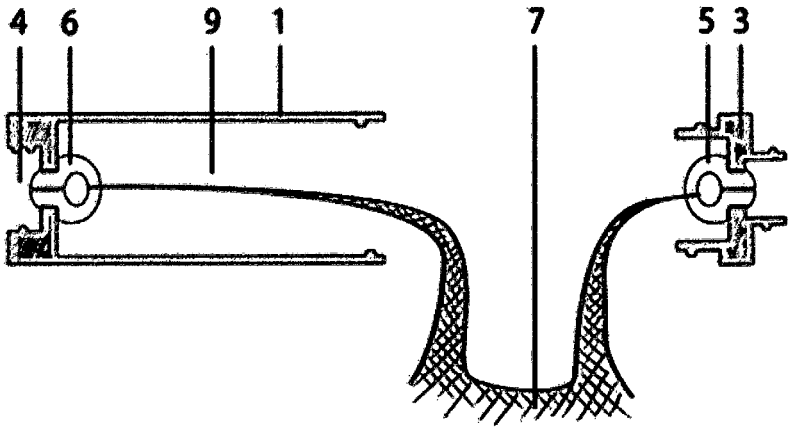
FIG. 3 depicts the invented system with its one end detached.
Figure 4:
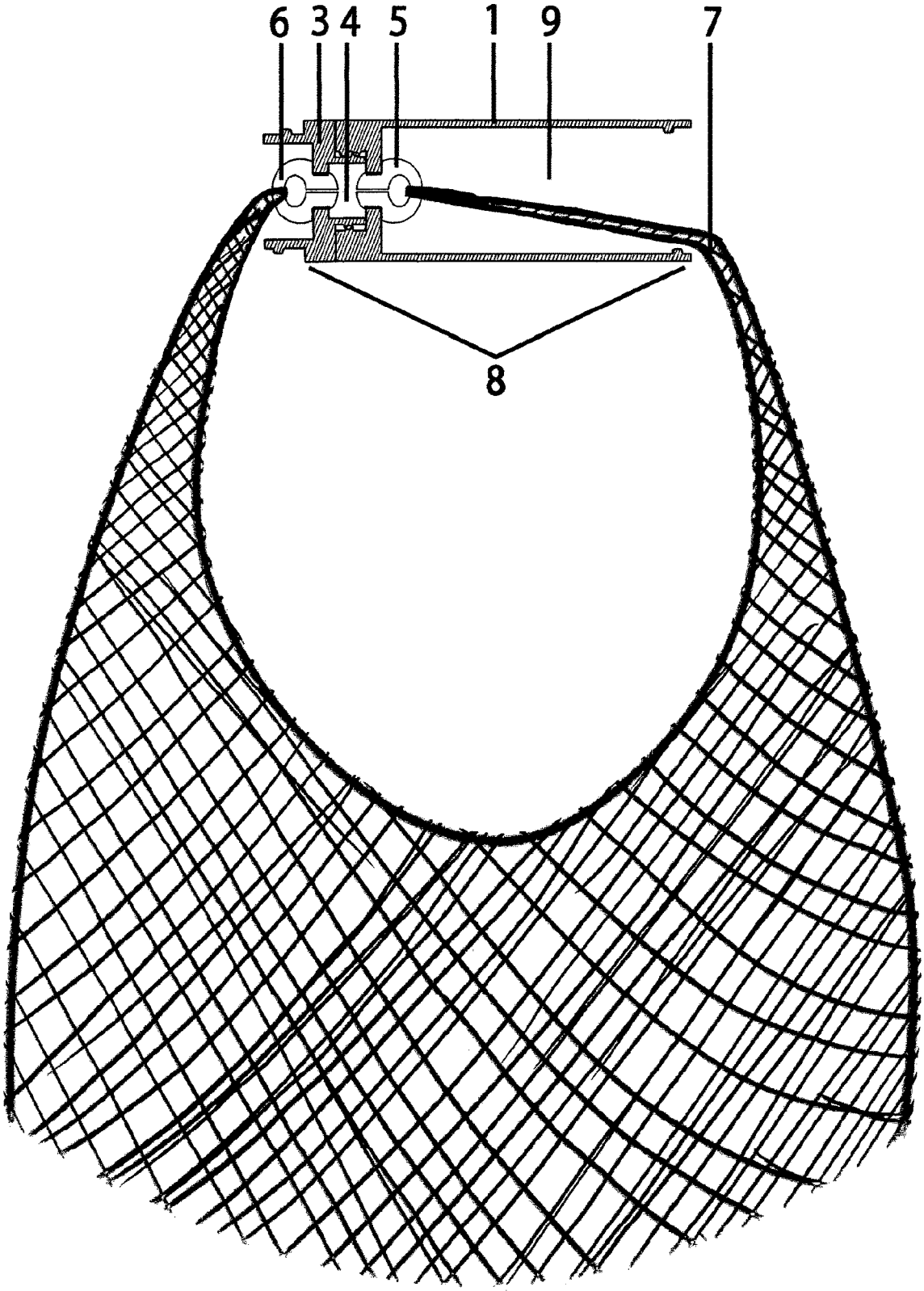
FIG. 4 depicts the invented system in a full unfolded state.

Then, enumeration is made of the basic parts of the invented system with reference to a corresponding numbering of these parts in the accompanying drawings, where they are presented in an indicative descriptive depiction, without scale but simply in proportion to the sizes of their parts.

DETAILED DESCRIPTION

In the following detailed description, numerous specific details are set forth by way of examples to provide a thorough understanding of the relevant teachings. However, it should be apparent that the present teachings may be practiced without such details. In other instances, well-known methods, procedures, components, and/or circuitry have been described at a relatively high-level, without detail, to avoid unnecessarily obscuring aspects of the present teachings.

According to the proposed indicative embodiment of the invention, the system comprises a main body (1) which is of cylindrical shape and is made of metal, plastic or other suitable material, which in its interior has a storage place (9) in which the net bag (7) is stored. The main body (1) has a detachable head (3) which at its end has a socket (2) to act as a keychain in order to be easily transported as it can hang on the keys, the bag or anywhere else the user wishes.

The detachable head (3) when disconnected from the main body (1) enables the net bag (7) to come out of its storage place (9) and unfold, and when it is then attached to the other end (4) of the main body (1) it acts as a handle (8). At both ends of the main body (1) safety fasteners (5) and (6) are placed on which the net bag (7) is attached. When the user wishes, the net bag (7) is folded and repositioned within the storage place (9) which secures by moving and attaching the detachable head (3) to the free end of the main body (1).

If it is desirable to replace the net bag (7), it is disassembled by the safety fasteners (5) on which a new net bag (7) is attached.

It is noted that the above description constitutes an indicative embodiment of the present disclosure and is limited to the above-referenced example, whereas its achievement is possible with similar ways and methods. Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A multi-purpose folding bag system with an anatomical handle, the folding bag system comprising:

a main body having a first end comprising a removable head, a second end, an inside storage place, and safety fasteners at each of the first end and the second end; and a net bag removably attached to the safety fasteners, wherein the net bag is configured to be located in the storage place in a storage configuration of the folding bag system, wherein the removable head is configured to be detached from the first end of the main body, the net bag is configured to be removed from the storage place, and the removable head is configured to be fitted to the second end of the main body to create the anatomical handle in a use configuration of the folding bag system, and wherein the net bag is configured to be replaced by disconnecting the net bag from the safety fasteners and attaching a new net bag to the safety fasteners.

2. The multi-purpose folding bag system of claim 1, wherein the removable head comprises a socket at an end of the removable head in order for the system to be hung on at least one of a key or a bag.

3. The multi-purpose folding bag system of claim 1, wherein the main body is cylindrical.

4. The multi-purpose folding bag system of claim 1, wherein the main body is made of plastic or polymeric material.

5. The multi-purpose folding bag system of claim 1, wherein the main body is metallic.

6. The multi-purpose folding bag system of claim 1, wherein:

the net bag is configured to be folded and repositioned within the storage place, and the removable head is configured to be detached from the second end of the main body, moved to the first end of the main body, and re-attached to the first end of the main body to return the folding bag system to the storage configuration.

* * * * *